US007665252B2

(12) United States Patent
Lang

(10) Patent No.: US 7,665,252 B2
(45) Date of Patent: Feb. 23, 2010

(54) WALL BRACING APPARATUS

(76) Inventor: Damian L. Lang, 12890 Waterford Rd., Waterford, OH (US) 45786

( * ) Notice: Subject to any disclaimer, the term of this patent is extended or adjusted under 35 U.S.C. 154(b) by 736 days.

(21) Appl. No.: 11/355,650

(22) Filed: Feb. 16, 2006

(65) Prior Publication Data

US 2006/0179728 A1 Aug. 17, 2006

Related U.S. Application Data

(60) Provisional application No. 60/653,440, filed on Feb. 16, 2005.

(51) Int. Cl.
*E04G 21/04* (2006.01)

(52) U.S. Cl. ..... 52/127.2; 52/146

(58) Field of Classification Search ..... 52/127.2, 52/146, 693, 170; 248/354.5
See application file for complete search history.

(56) References Cited

U.S. PATENT DOCUMENTS 1,850,462 A * 3/1932 Kinninger ..... 52/98
3,034,606 A * 5/1962 Wiegand ..... 52/64
3,550,898 A * 12/1970 Citrullo et al. ..... 249/195
3,788,026 A * 1/1974 Cook ..... 52/127.2
3,817,006 A * 6/1974 Williams ..... 52/127.2
3,874,625 A * 4/1975 Hansen et al. ..... 248/354.5
4,000,592 A 1/1977 Kelly
4,068,427 A 1/1978 Camardo
4,070,833 A 1/1978 Hancock
4,079,556 A 3/1978 Luck et al.
4,083,156 A 4/1978 Tye
5,481,836 A 1/1996 Miller et al.
5,660,006 A 8/1997 Emerson, Jr.
5,704,488 A * 1/1998 Smith ..... 206/598
5,956,906 A 9/1999 Berich et al.
6,065,254 A 5/2000 Lanka
6,112,475 A 9/2000 Truitt
6,539,677 B1 4/2003 Lanka
6,854,222 B2 * 2/2005 Hansort ..... 52/127.2

* cited by examiner

*Primary Examiner*—Basil Katcheves
(74) *Attorney, Agent, or Firm*—Jason H. Foster; Kremblas, Foster, Phillips & Pollick

(57) ABSTRACT

A wall bracing apparatus for mounting between a wall and the floor during construction. The wall bracing apparatus includes a tube that is mounted to a wall-mounted device and a floor-mounted device. The wall-mounted device has a backing plate and a front plate on opposite sides of the wall. A t-bar having a head at one end and a shaft through which a hole is formed extends through aligned central apertures in the plates and a wedge is inserted in the hole near the front plate end of the t-bar. A pair of ears on the front plate has aligned holes through which a pin extends that is also inserted through the tube. A duplicate of the front plate can be mounted to the floor and the opposite end of the tube can pivotably mount to the ears thereof.

16 Claims, 8 Drawing Sheets

WALL BRACING APPARATUS

CROSS-REFERENCES TO RELATED APPLICATIONS

This application claims the benefit of U.S. Provisional Application No. 60/653,440 filed Feb. 16, 2005.

STATEMENT REGARDING FEDERALLY-SPONSORED RESEARCH AND DEVELOPMENT

Not Applicable

REFERENCE TO AN APPENDIX

Not Applicable

BACKGROUND OF THE INVENTION

1. Field of the Invention

This invention relates generally to construction tools, and more particularly to a tool used to brace a masonry or other walls during construction.

2. Description of the Related Art

It is well known that until a masonry wall is permanently supported, it is unstable and can fall, especially if wind loads on it are substantial. Thus, during the construction process braces and other devices are used to support the walls until the building is completed or the walls are at least self-supporting. Many devices used for supporting masonry walls are cumbersome and heavy, and they only adjust to walls that are certain heights, require forklifts or several laborers to install, require extra space to store and use parts that are only useful for one particular purpose. Thus, when a wall supporting apparatus is being installed, there is very little flexibility as to how these braces can be installed.

Additionally, existing wall bracing devices are made in certain sizes that are not flexible for use by contractors. Contractors must purchase different length braces for different wall heights. The bracing devices also have end pieces that are fixed to the poles, thereby making the bracing device suitable only to install after the wall is built and not while the wall is being constructed. Furthermore, since most bracing devices are long enough to be installed at high points in the wall, such as heights above 10', they are conventionally too long and cumbersome to be transported easily.

The need exists for a wall bracing apparatus with parts that are easily adaptable to any height and for use in many circumstances, thereby eliminating searching effort, simplifying the installation process, and making the apparatus easily transported and stored when the apparatus is not being used.

BRIEF SUMMARY OF THE INVENTION

The invention is an apparatus for bracing a wall during construction. A backing plate is positioned on a first side of the wall. A front plate is mounted on a second side of the wall opposite the backing plate. The front and backing plates have apertures that can align when the plates are on opposite sides of the wall. The front plate has opposed ears with a first pair of aligned holes through which a pin extends when a pole with aligned holes is positioned between the ears. The pole is thus pivotably mounted to the ears and extends down, up and/or away from the wall.

A fastener, such as a t-bar, has a head, a shaft and at least one hole, and preferably a plurality of holes, near one end.

The t-bar is preferably a plate with the head wider than the shaft, and the shaft extends through the aperture in the backing plate, the aperture in the front plate that is aligned with the aperture in the backing plate and a bore formed in the wall disposed between the plates. A wedge extends through the hole in the t-bar near the front plate to restrain the t-bar from exiting the front plate when a force is applied to the front plate.

In one embodiment of the invention, the ears have aligned slots through which the wedge extends, and the ears have a second pair of aligned holes that can accept a pivot pin at both ends of the plate. The wedge preferably has a plurality of holes for a pin to extend through in order to prevent the wedge from withdrawing unintentionally from the hole in the t-bar and/or the front plate.

In another embodiment of the front plate, the ears are near one end of the front plate, the aperture is substantially centrally located and a first set of holes is formed near an end opposite the ears for fasteners. In this embodiment, it is preferred that at least one hole is formed in the front plate between the ears for inserting at least one fastener.

Figure 11:
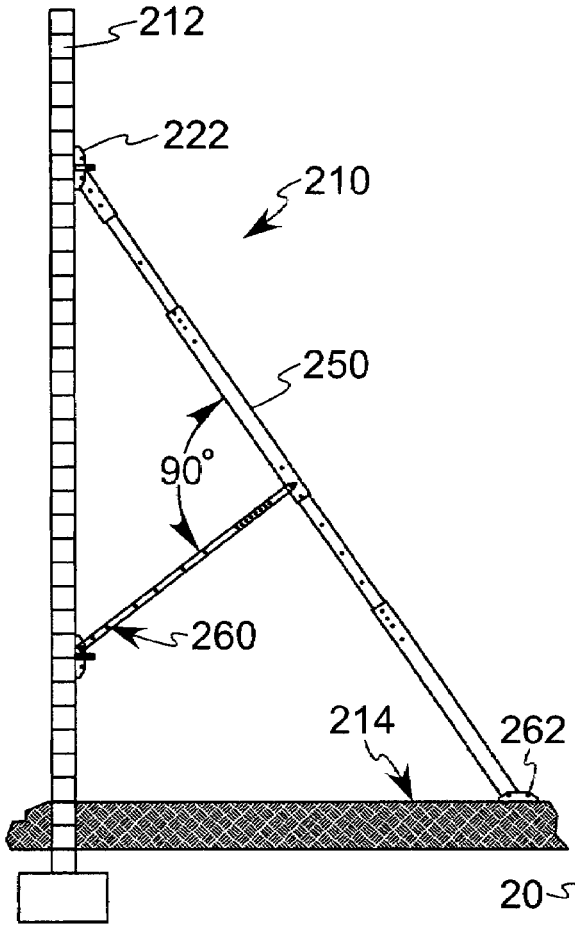
FIG. 11 is a side view illustrating another embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 1:
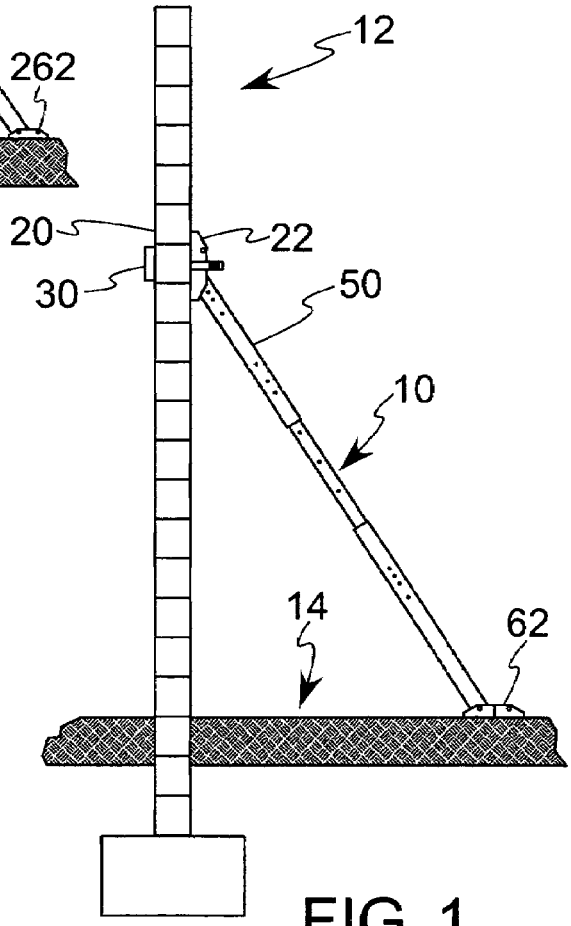
FIG. 1 is a side view illustrating an embodiment of the present invention.

An embodiment of the present invention is shown in FIG. 1 attached to a wall 12. The apparatus 10 braces the wall 12 when the wall is being constructed, which includes when the wall is being built or already built on the site or elsewhere and erected on the site. The wall can be a concrete masonry unit (CMU) wall, poured concrete wall, a brick wall, a wooden wall or any other material of which walls are built. The preferred embodiment of the invention is designed for a CMU wall. The apparatus 10 extends between the wall 12 and the floor 14, footing, deadman, or other surface, and attaches securely to the wall 12 and the floor 14 as described in further detail below. Thus, the apparatus 10 functions to brace the wall against falling over prior to completion of the construction when the wall has substantial support from other components of the building of which the wall is a part.

Figure 2:
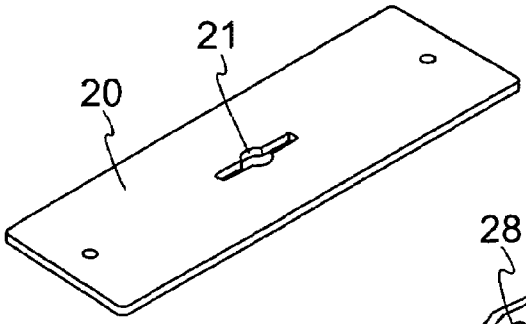
FIG. 2 is a view in perspective illustrating a backing plate.
Figure 4:
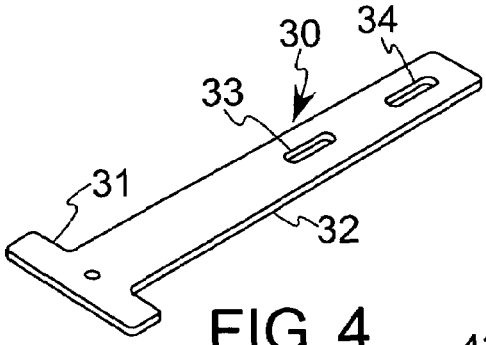
FIG. 4 is a view in perspective illustrating a t-bar.
Figure 5:
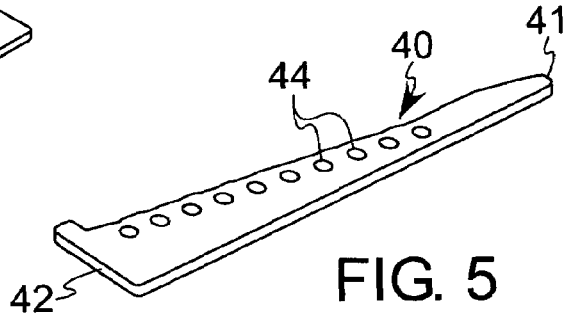
FIG. 5 is a view in perspective illustrating a wedge.
Figure 6:
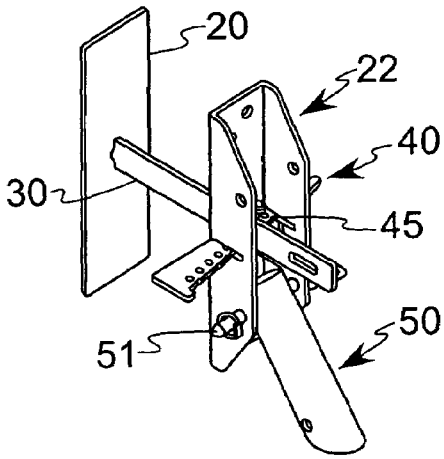
FIG. 6 is a view in perspective illustrating an embodiment of the invention in an assembled state.

The components of the apparatus 10 that attach to the wall 12 are shown individually in FIGS. 2-5, and assembled in FIG. 6. The backing plate 20, shown in FIG. 2, is a planar, preferably steel plate with an aperture 21 centrally located therein. The backing plate 20 is positioned on one side of the wall 12 and forms a wide support to prevent any fastener extended through the wall from either pulling through or damaging the wall upon the application of a load on the wall.

Figure 3:
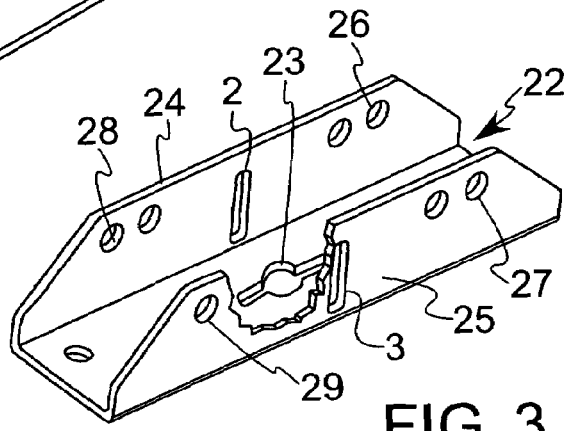
FIG. 3 is a view in perspective illustrating a front plate.

The front plate 22 is shown in FIG. 3 as a planar, preferably steel plate with sides bent upwardly at right angles to the central region to form ears 24 and 25. The aligned slots 2 and 3 are formed through the ears 24 and 25 for receiving the wedge described below. The front plate 22 is positioned on the opposite side of the wall 12 as the backing plate 20, as shown in FIG. 1, and prevents pulling through and damage to the wall, but also provides a structure to which a bracing tube can mount.

There is an aperture 23 formed in the central region of the plate 22 for receiving an elongated fastener, such as the t-bar 30 shown in FIG. 4. This aperture 23 is formed in a shape that can receive a round anchor at the wall 12 or the floor 14. The t-bar 30 is a preferably planar steel plate with a head 31 and a shaft 32 having at least one hole, and preferably a plurality of holes 33 and 34. The t-bar is a fastener for connecting the backing plate 20 and the front plate 22 by inserting the t-bar 30 through the apertures 21 and 23 of the respective plates that are aligned on opposite sides of the wall 12 as shown in FIG. 1, and an aligned bore formed in the wall 12. The bore formed in the wall 12 can be formed by drilling, or can simply be formed by forcing the t-bar 30 therethrough. In the case of a site-built concrete block wall, the t-bar 30 can simply be pushed through the uncured mortar between two blocks. The head 31 seats against the backing plate 20 and the portion of the shaft 32 with at least one of the holes 33 and 34 extends beyond the front plate 22.

A wedge 40, which is preferably the steel plate shown in FIG. 5 having a narrow end 41 and a wider end 42, extends, narrow end 41 first, through one of the t-bar holes 33 and 34 that is closest to the front plate 22. The wedge 40 also extends through the slots 2 and 3. There are many holes 44 formed along the wedge 40, and once the wedge is forced into the hole in the t-bar 30 as far as possible, a pin 45 is extended through the hole 44 that is closest to the t-bar shaft 32 and on the side of the t-bar 30 that faces the narrow end 41. The pin 45 is shown in FIG. 6 in the fixed position, where the backing plate 20, front plate 22, t-bar 30 and wedge 40 are in the wall-clamping positions described above. The assembled structure very securely holds the wall 12 between the plates 20 and 22 so that a bracing tube 50 can be mounted thereto.

A pair of aligned holes 26 and 27 is formed in the ears 24 and 25, respectively, of the front plate 22, and a second pair of aligned holes 28 and 29 is formed at the opposite end of the ears 24 and 25. These aligned holes receive a pin 51 that extends through the pivotably mounted bracing tube 50, as shown in FIGS. 1 and 6. The aligned holes 26 and 27 at one end of the ears 24 and 25 and the aligned holes 28 and 29 at the other end of the ears make it possible to mount two bracing tubes to a single front bracket 22 or allows one bracing tube to be attached to either end of the ears. This saves the user from using a separate front plate for each tube. The bracing member is preferably a steel tube with strength sufficient to support the wall 12 against wind and other loads during construction, although structural members of other materials can be used instead of steel, including, but not limited to, composites and aluminum. The tube 50 can be attached to other tubes, such as by telescopically inserting tubes of a particular outer diameter into a bore formed in tubes of slightly greater inner diameter and extending pins through aligned holes formed therein, in order to effectively bridge the gap between the front plate 22 and the floor 14, footing, "deadman" or other surface.

Preferably, the tube 50 pivotably mounts at its lower end to a front plate 62 mounted to the floor 14. The front plate 62 is preferably identical to the front plate 22. The tube 50 mounts to the plate 62 by inserting a pin 53 through the aligned holes 68 and 69 formed in the ears 64 and 65, respectively and an aligned hole in the tube 50. The fasteners 66 are then mounted through holes formed in the center and/or near one or both ends of the plate 62 and extend into the floor 14. The plate 62 is thereby securely mounted to the floor 14. The aperture 23 is formed with a circular shaped region in the elongated slot to receive either the t-bar 30 or a round anchor at the wall 12 or the floor 14. This strongly mounts the brace apparatus 10 in place to both the wall 12 and the floor 14.

Figure 16:
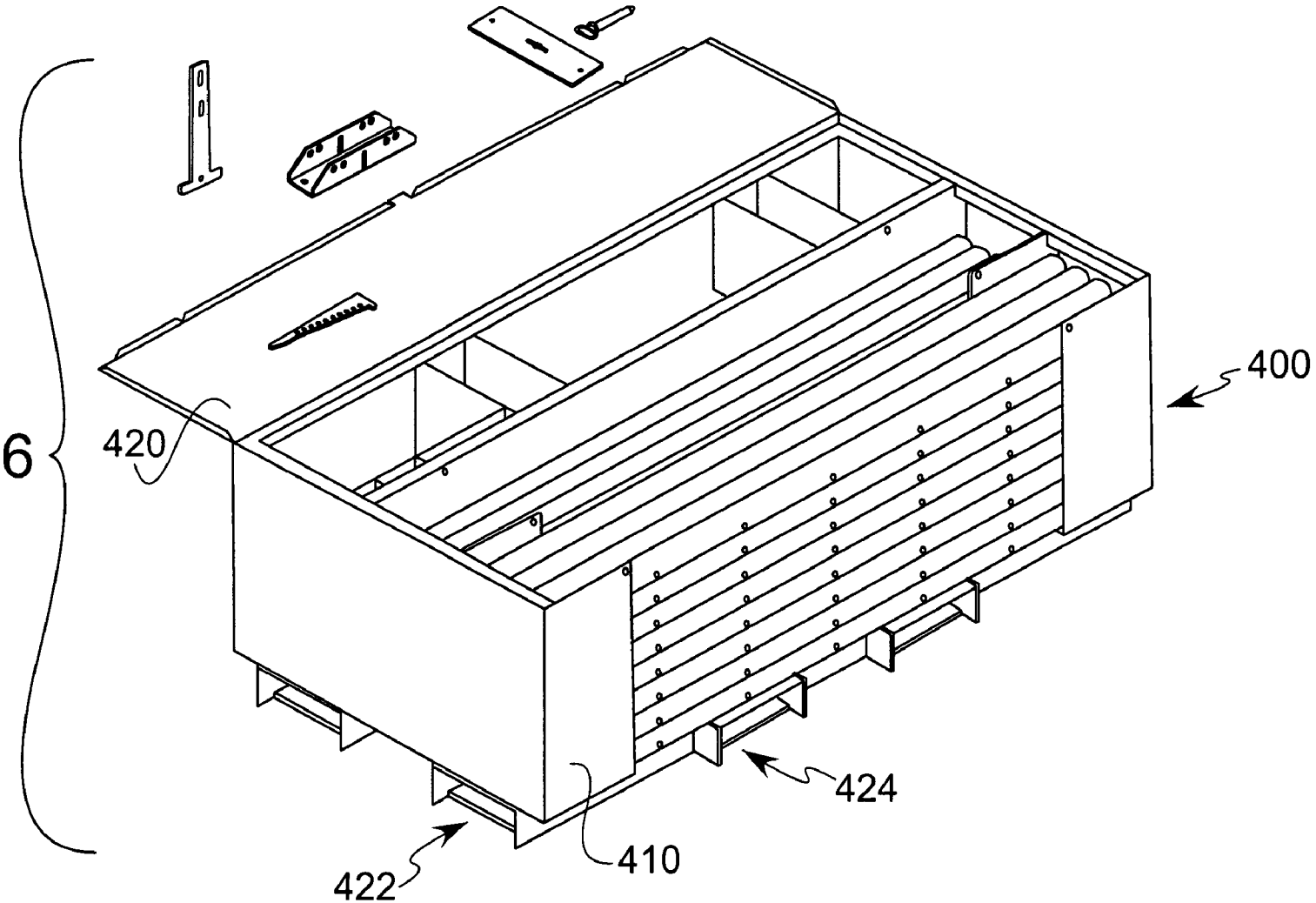
FIG. 16 is a view in perspective illustrating a container for the wall-bracing apparatus.

By using the same front plate for mounting the apparatus 10 to the wall 12 and the floor 14, the present invention reduces the number of different components necessary for a wall-bracing apparatus. The FIG. 16 container 400 has a receptacle 410, a hinged and locking lid 420, and a pair of forklift pockets 422 mounted beneath the container 400. Another pair of forklift pockets 424 is mounted transverse, and preferably perpendicular, to the pockets 422. The container 400 is easily loaded into a vehicle or moved around a site by inserting forklift forks into the pockets and moving it in a conventional manner. By reducing the number of different components in the apparatus, organization of the components in the container 400 is easier.

Additionally, by using the components described above, the wall-mounted components can mount to a wall quickly and safely, and can be disassembled quickly and safely. For example, the wedge 40 is simply tapped into one of the holes in the t-bar 30 once the t-bar 30 is extended through the front and back plates 22 and 20, and then a pin is mounted in a hole in the wedge. In order to remove all of the components, one need merely remove the pin, tap out the wedge, withdraw the t-bar from the plates and the entire structure is removed from the wall.

Additionally, because the t-bar can have multiple holes formed therein, each hole can be associated with a particular wall thickness. Thus, there is no measurement needed in order to determine where the wedge should be driven. The wedge is simply inserted into the hole closest to the front plate that it can fit into.

Figure 9:
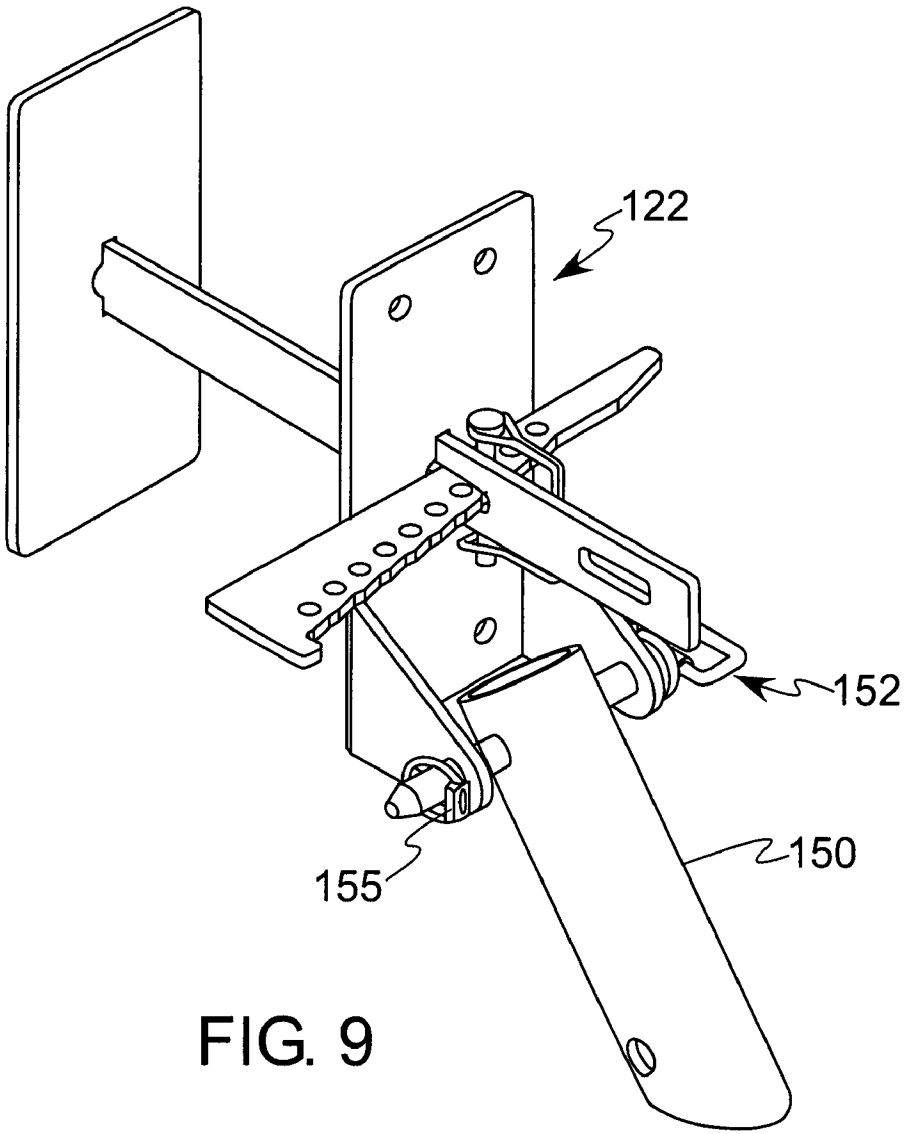
FIG. 9 is a view in perspective illustrating an embodiment of the invention using the plate of FIG. 8.
Figure 8:
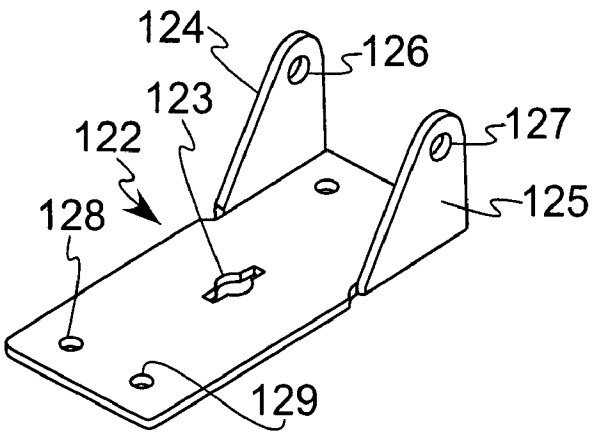
FIG. 8 is a view in perspective illustrating another embodiment of the plate.
Figure 10:
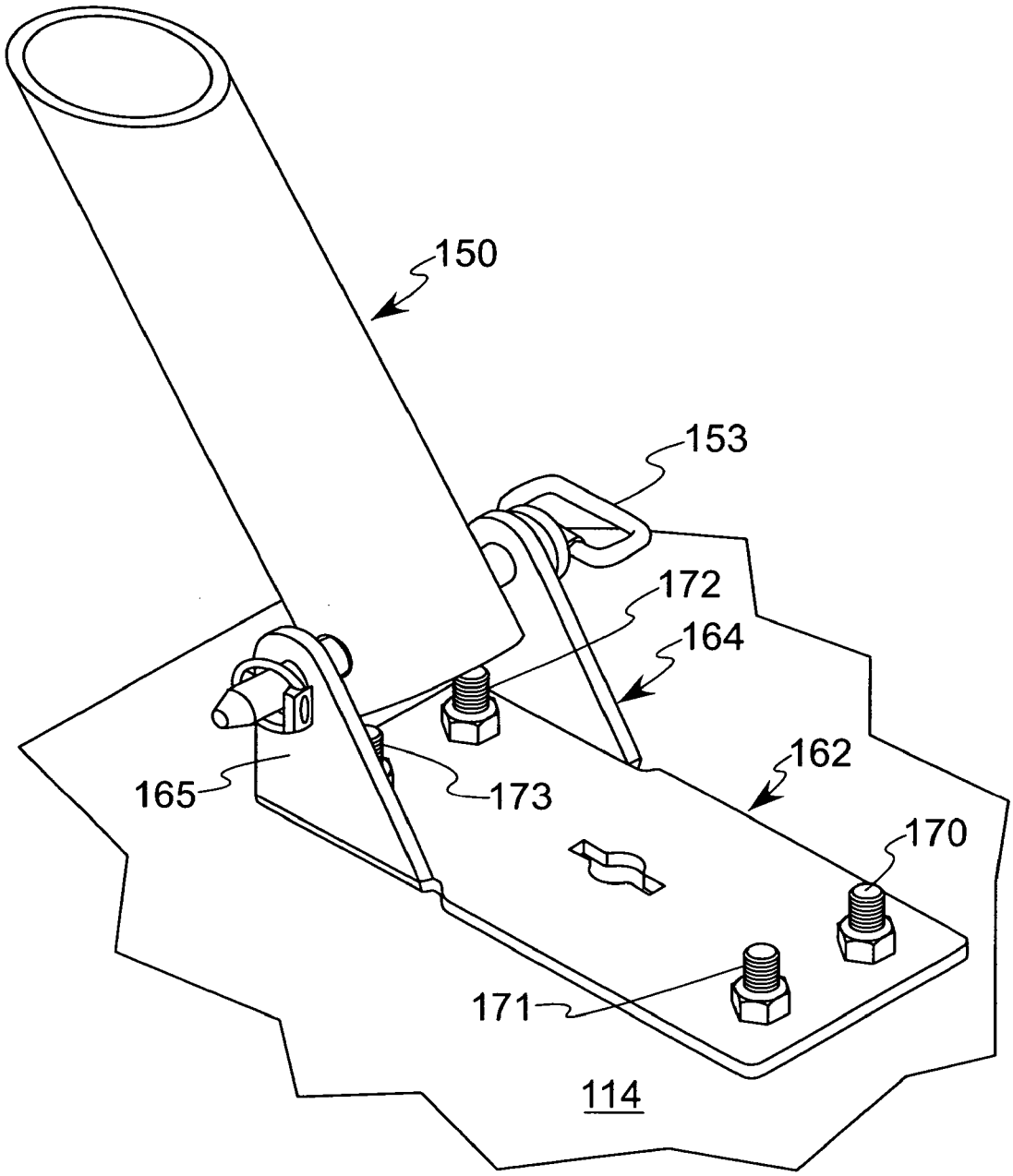
FIG. 10 is a view in perspective illustrating an embodiment of the invention in an assembled state.

An alternative front plate 122 is shown in FIGS. 8, 9 and 10. The plate 122 has a central aperture 123 and a pair of ears 124 and 125. However, the ears 124 and 125 are positioned at only one end of the plate 122. A pair of aligned holes 126 and 127 extend through the ears 124 and 125, respectively. Holes, such as the holes 128 and 129, are formed through the plate 122 at both ends. The hole in the center of plate 122 is formed to be used as a slot with a round section to receive the t-bar or a round anchor at the wall 12 or the floor 14.

As shown in FIG. 9, the front plate 122 is used in substantially the same manner as the front plate 22 of FIG. 3. The bracing tube 150 mounts to the ears 124 and 125 by the pin 152 extending through the holes 126 and 127, which are aligned with a hole formed through the tube 150. A latch pin 155 is then mounted through the pin 152 to prevent the pin 152 from falling out.

As shown in FIG. 10, the front plate 162, which is preferably identical to the front plate 122, mounts to a floor 114 with the bracing tube 150 mounted thereto. The plate 162 has ears 164 and 165 through which are formed aligned holes into which a pin 153 is extended. An aligned hole is also formed in the tube 150, and the pin 153 extends therethrough. Fasteners, such as the screws 170, 171, 172 and 173, extend through holes formed at the end of the plate 162 opposite the ears 164 and 165, and through holes formed between the ears 164 and 165. The aperture in the center of the front plate 162 can also be used to receive a larger anchor at the wall 12 or floor 14.

Figure 7:
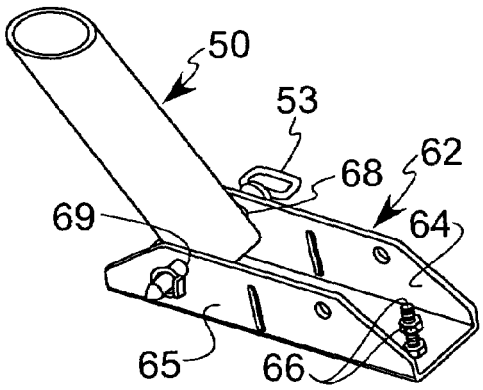
FIG. 7 is a view in perspective illustrating an embodiment of the invention in an assembled state.
Figure 12:
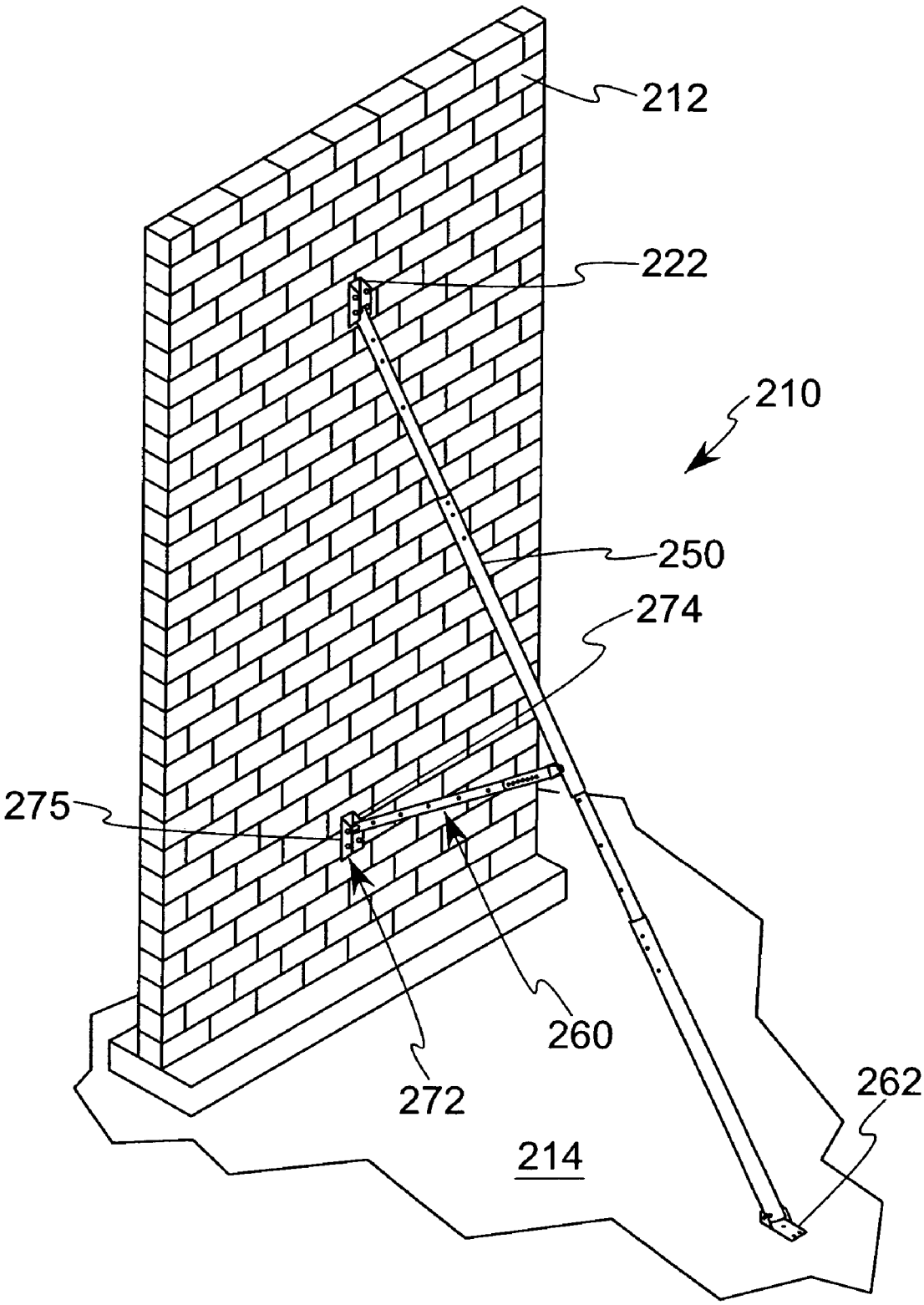
FIG. 12 is a view in perspective illustrating another embodiment of the invention.

The bracing apparatus 210, shown in FIGS. 11 and 12, has a wall support, which is preferably identical to that shown in FIG. 6, and a floor support, which is preferably identical to that shown in FIG. 7. Additionally, however, the tube 250 is supported by a kicker support 260. The kicker support 260 is mounted to the wall 212 using the components shown in FIG. 6. Thus, the tube 261 of the kicker support 260 mounts to the ears 24 and 25.

Figure 13:
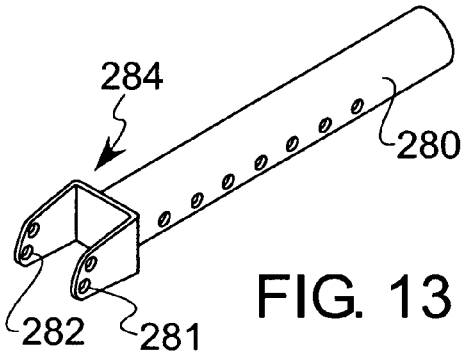
FIG. 13 is a view in perspective illustrating an adjustment tube.
Figure 14:
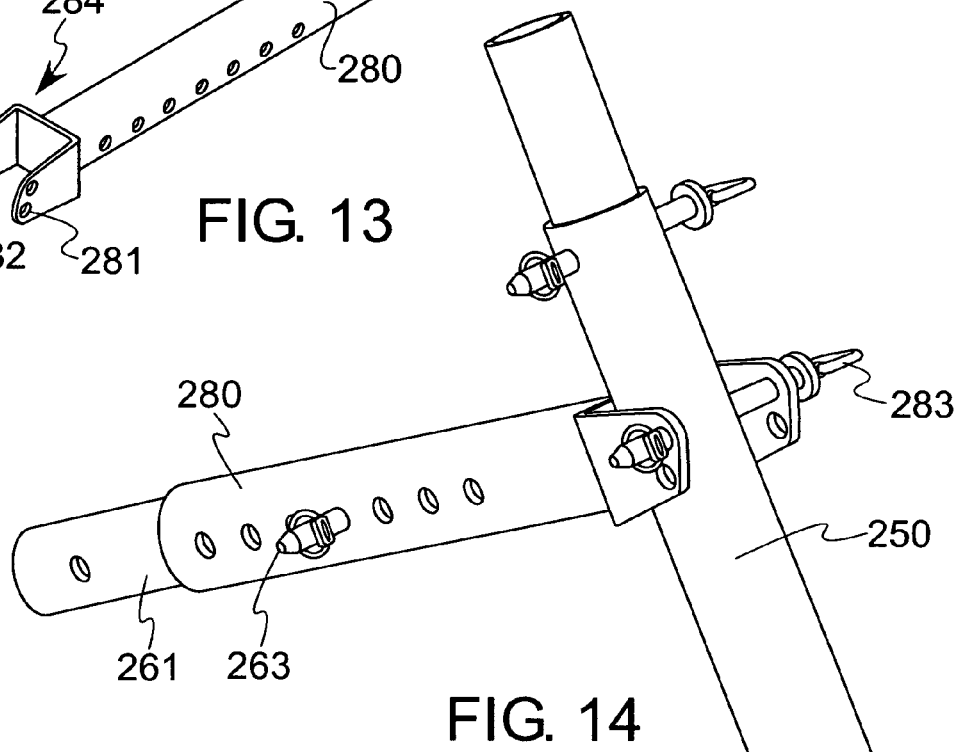
FIG. 14 is a view in perspective illustrating the cooperation of the adjustment tube and the bracing tube.
Figure 15:
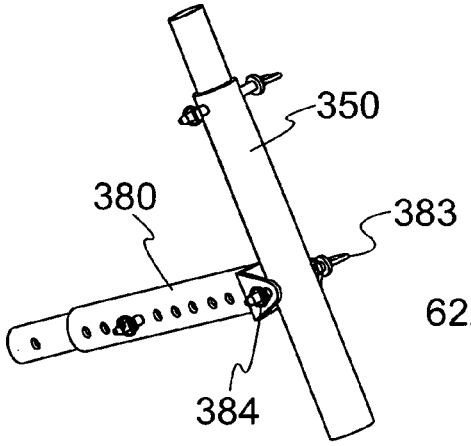
FIG. 15 is a view in perspective illustrating the cooperation of an alternative adjustment tube and a bracing tube.

The kicker support 260 mounts to the tube 250 by the components shown in FIGS. 13 and 14. The adjustment tube 280 is mounted to the tube 261 by a pin inserted through aligned holes in the telescopically-inserted tubes. A fork 284 is mounted at the opposite end of the adjustment tube 280 having ears through which the aligned holes 281 and 282 are formed. The holes 281 and 282 accept a pin 283 that is inserted therethrough when the tube 250 is disposed between the ears of the fork 284. Thus, the pin 283 prevents the tube 250 from being removed from the fork 284, and connects the kicker support 260 to the tube 250. If it is preferred to prevent any movement of the fork of an adjustment tube longitudinally relative to a pipe, a pin 383 can be inserted through the ears of the fork 384, as shown in FIG. 15, and through the pipe 350. The adjustment tube 380 is thus pivotably mounted to the tube 350.

Figure 17:
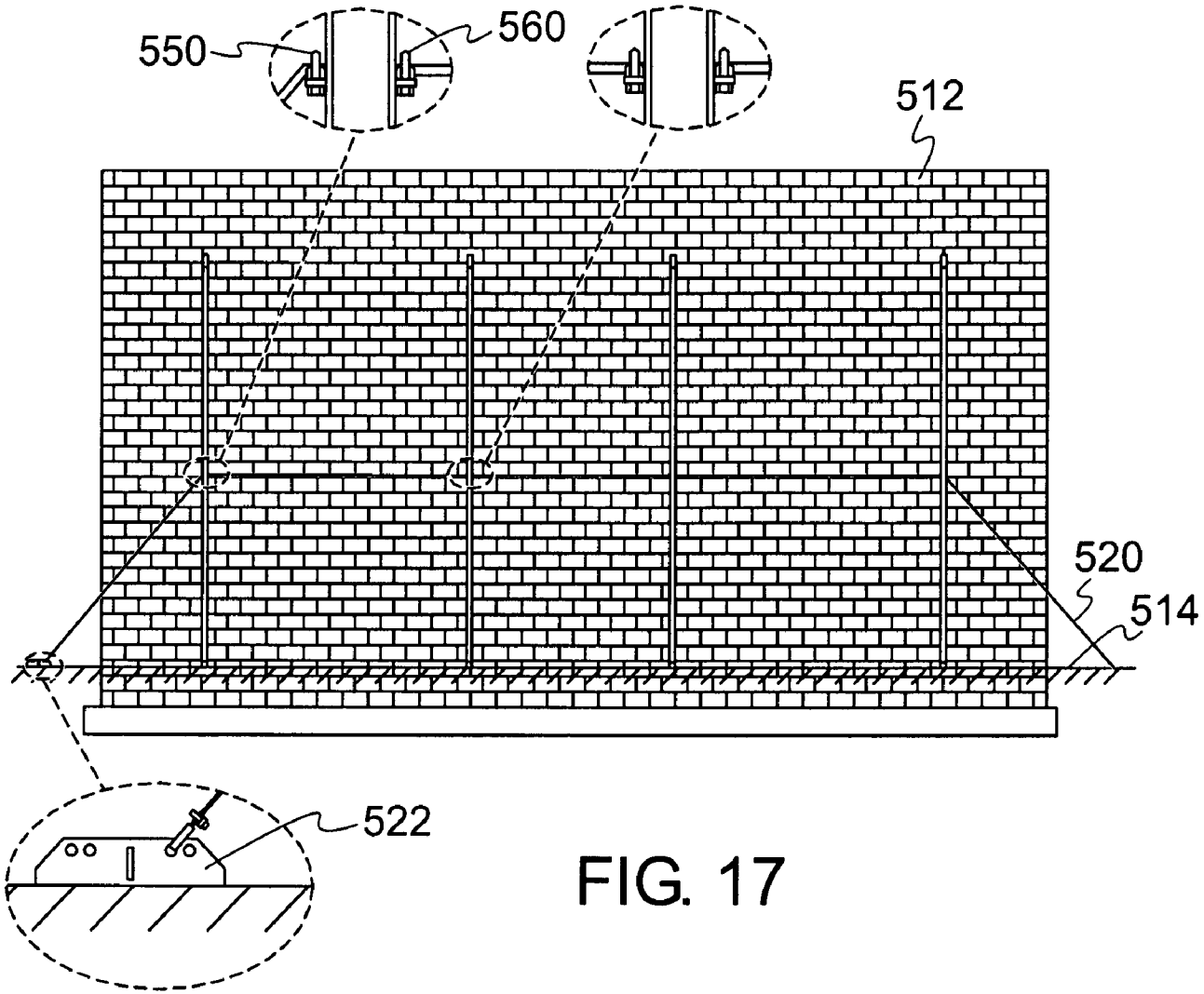
FIG. 17 is a front schematic view illustrating a cable support for the present invention.
Figure 18:
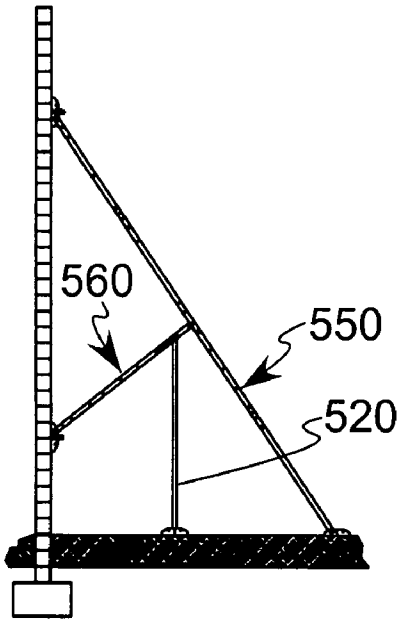
FIG. 18 is a side schematic view illustrating the cable support of FIG. 17.

In an alternative embodiment of the present invention shown in FIGS. 17 and 18, a cable 520, such as three-eighths inch braided cable, is used to supplement the wall-bracing apparatus or apparatuses. The cable attaches to the floor 514 using the front bracket 522, which is substantially identical to the front bracket 22 shown in FIG. 3. The cable 520 extends through holes in the kicker support 560 and any other aligned kicker supports. Then the cable is mounted to the floor using another front bracket (not shown) that is like the front bracket 22. Preferably cable clamps 550 and 560 are used on opposite sides of the kicker supports to prevent the cable 520 from moving relative to the kicker supports. However, the cable can be attached to the kicker support 560 or the pole 550 with other means of attachment using a U-shaped type of bracket. The cable 520, therefore reduces lateral sway of the bracing apparatuses, thereby further reinforcing the bracing apparatus and making it stronger.

Figure 19:
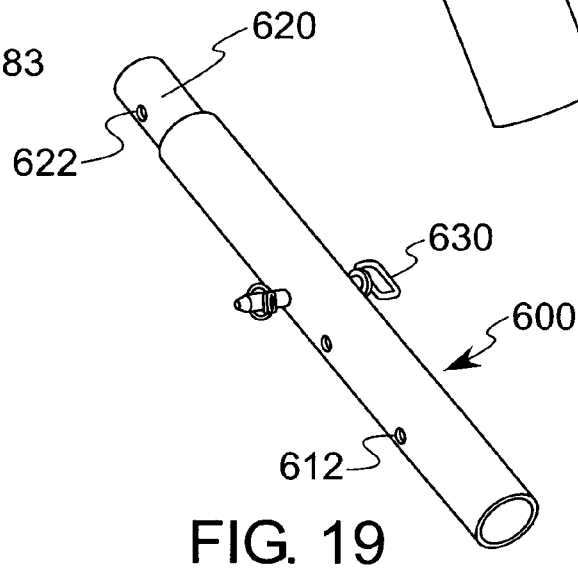
FIG. 19 is a view in perspective illustrating the tube components of the present invention.

One significant improvement in the invention is the ability to construct bracing tubes of virtually any length by using a combination of two or more tubes. The component tubes of which the assembled bracing tubes are constructed are preferably approximately seven feet long or longer hollow steel pipes 600 and 620 with aligned pairs of holes 612 and 622 spaced along their length as shown in FIG. 19. The pipes could also be substituted with other materials that will slide into one another in the same manner as steel tubing. The pipes 600 and 620 are made in at least two different diameters, so that a pipe of one diameter can fit at least a portion of its length inside a pipe of the larger diameter. Furthermore, the ends of each pipe are the same, so that any pipe can be used as an end to attach to other components. This permits the pipes to be adjoined to each other by telescopically inserting one pipe into the other and inserting a pin 630 through the aligned holes in the two pipes. These pipes can then be joined to front brackets at both ends or to kicker adjustment tubes as described herein.

Because there are many of the pipes 600 and 620, bracing members that extend between walls and floors, such as the bracing tubes 50 and 250, can be built to any length desired that is greater than seven feet and less than the sum total of all of the pipes connected together. And because the standard pipes 600 and 620 are approximately seven feet long, they can be disassembled, stacked beside each other and carried in the container 400 (see FIG. 16). The receptacle 410 is approximately seven feet four inches long, forty-two inches wide and a height that will fit inside the bed of a typical pickup truck. Thus, because the pipes of the present invention are able to be disassembled and reassembled quickly and easily, the invention is both portable and adaptable to virtually any wall-bracing task.

While certain preferred embodiments of the present invention have been disclosed in detail, it is to be understood that various modifications may be adopted without departing from the spirit of the invention or scope of the following claims.

The invention claimed is:

1. An apparatus bracing a wall during construction, the apparatus comprising:

(a) a backing plate on a first side of the wall, the plate having an aperture;

(b) a front plate on a second side of the wall opposite the backing plate, the front plate having an aperture aligned with the aperture of the backing plate and opposed ears extending from opposite sides of the front plate, the ears having a first pair of aligned holes and a second pair of aligned holes spaced from the first pair of aligned holes;

(c) an elongated fastener having a head and a shaft, the shaft extending through the aperture in the backing plate with the head adjacent the backing plate, through the aperture in the front plate that is aligned with the aperture in the back plate and through the wall disposed between the front and backing plates, the elongated fastener having at least one hole formed through the shaft near a shaft end opposite the head, said at least one hole being disposed between the opposed ears of the front plate, wherein the second pair of aligned holes in the ears is aligned with said at least one hole in the elongated fastener's shaft;

(d) a wedge extending through said at least one hole in the elongated fastener's shaft and through the second pair of aligned holes in the ears; and (e) a first pivot pin extending through the first pair of aligned holes in the ears to which a first end of a bracing member pivotably mounts and extends away from the wall.

2. The apparatus in accordance with claim 1, wherein the elongated fastener is a t-bar.

3. The apparatus in accordance with claim 2, further comprising a plurality of holes through the wedge, and a fastening pin extending through at least one of said plurality of holes.

4. The apparatus in accordance with claim 1, wherein the elongated fastener has a plurality of holes near one end for the wedge to extend through, each of said holes corresponding to a different wall thickness.

5. The apparatus in accordance with claim 4, wherein the elongated fastener is a plate with the head wider than the shaft.

6. The apparatus in accordance with claim 1, wherein the ears are near one end of the front plate, the aperture on the front plate is substantially centrally located and a third set of holes is formed near an end opposite the ears for inserting fasteners therethrough.

7. The apparatus in accordance with claim 6, further comprising at least one hole formed in the front plate between the ears for inserting at least one fastener.

8. The apparatus in accordance with claim 1, further comprising a floor plate that is substantially identical to the front plate and mounted to a stable structure spaced from the wall, the floor plate having opposed ears extending from opposite sides of the floor plate with a fourth pair of aligned holes through which a second pivot pin extends and to which the bracing member extending away from the wall pivotably mounts at a second bracing member end disposed between the opposed pair of ears.

9. The apparatus in accordance with claim 8, wherein the bracing member extending away from the wall is an assembly of tubes telescopically mounted together.

10. The apparatus in accordance with claim 8, wherein a second bracing member attaches to the front plate at a fifth pair of aligned holes formed in the opposed ears near an end of the opposed ears opposite the first pair of aligned holes and a second pivot pin extends through the fifth pair of aligned holes through an aperture formed in an end of the second bracing member, thereby pivotably mounting the second bracing member to the front plate.

11. The apparatus in accordance with claim 9, wherein each of said tubes has a first and a second end, each end has connection means, and the first end connection means is substantially identical to the connection means of the second end.

12. The apparatus in accordance with claim 9, further comprising a cable extending from the bracing member to attachment to a floor adjacent the wall.

13. The apparatus in accordance with claim 11, further comprising a lockable container into which the tubes, the plates, the fastener and the wedge fit.

14. The apparatus in accordance with claim 13, wherein the container has forklift pockets mounted thereto.

15. The apparatus in accordance with claim 8, wherein the floor plate is mounted to a floor adjacent the wall.

16. The apparatus in accordance with claim 8, wherein the floor plate is mounted to a weight mounted in a floor adjacent the wall.

* * * * *

UNITED STATES PATENT AND TRADEMARK OFFICE

CERTIFICATE OF CORRECTION

PATENT NO. : 7,665,252 B2
APPLICATION NO. : 11/355650
DATED : February 23, 2010
INVENTOR(S) : Damian L. Lang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1013 days.

Signed and Sealed this

Seventh Day of December, 2010

David J. Kappos

David J. Kappos
*Director of the United States Patent and Trademark Office*